US009538805B2

(12) United States Patent
Tronchin et al.

(10) Patent No.: US 9,538,805 B2
(45) Date of Patent: Jan. 10, 2017

(54) SKI BOOT AND SIMILAR SPORT FOOTWEAR

(71) Applicant: CALZATURIFICIO DAL BELLO S.R.L., Casella d'Asolo (TV) (IT)

(72) Inventors: Guido Tronchin, Altivole (IT); Rino Dal Bello, Asolo (IT)

(73) Assignee: CALZATURIFICO DAL BELLO S.R.L., Casella d'Asolo (TV) (IT)

( * ) Notice: Subject to any disclaimer, the term of this patent is extended or adjusted under 35 U.S.C. 154(b) by 44 days.

(21) Appl. No.: 14/313,302

(22) Filed: Jun. 24, 2014

(65) Prior Publication Data

US 2014/0373393 A1 Dec. 25, 2014

(30) Foreign Application Priority Data

Jun. 24, 2013 (IT) ..... UD2013A0089

(51) Int. Cl.
*A43B 5/04* (2006.01)
*A43C 11/00* (2006.01)
*A43C 11/14* (2006.01)

(52) U.S. Cl.
CPC ..... *A43B 5/04* (2013.01); *A43B 5/0433* (2013.01); *A43B 5/0474* (2013.01); *A43C 11/00* (2013.01);
(Continued)

(58) Field of Classification Search
CPC ..... A43B 5/04; A43B 5/0496; A43B 5/0429; A43B 5/0433; A43B 5/0474; A43C 11/00; A43C 11/1473; A43C 11/144; A43C 11/1793; A43C 11/008; A43C 11/1466; A43C 11/146; A43C 11/20; Y10T 24/2106; Y10T 24/2142; Y10T 24/216; Y10T 24/2183
(Continued)

(56) References Cited

U.S. PATENT DOCUMENTS 177,396 A * 5/1876 Harris ..... A43C 1/00 36/50.1
1,253,658 A * 1/1918 Wilson ..... A43C 11/1406 24/68 SK
(Continued)

FOREIGN PATENT DOCUMENTS

CH 471 553 A 4/1969
CH EP 0230063 A1 * 7/1987 ..... A43B 5/0447
(Continued)

OTHER PUBLICATIONS

Italian Search Report and Written Opinion issed on Feb. 12, 2014 in Intalian Patent Application No. UD20130089.
(Continued)

*Primary Examiner* — Jila M Mohandesi
*Assistant Examiner* — Katharine Gracz
(74) *Attorney, Agent, or Firm* — Panitch Schwarze Belisario & Nadel LLP

(57) ABSTRACT

A sport footwear includes at least an upper part configured to act as an upper cuff and a lower part acting as a lower shell. The upper part has a pair of opposite and distanced lateral edges. At least one terminal closing mechanism is provided on the lateral edges and at least one other closing mechanism, positioned adjacent to the terminal closing mechanism, which extend frontally astride the lateral edges. The sport footwear includes a single command mechanism configured to drive both of the closing mechanisms at the same time. The command mechanism includes at least one main lever pivoted on a first of the lateral edges. Moreover, the closing mechanisms are each provided with a respective drive end connected to the main lever, near the first of the lateral edges, and with an opposite anchoring end connected to a second of the lateral edges.

10 Claims, 5 Drawing Sheets

(52) U.S. Cl.
CPC ..... *A43C 11/008* (2013.01); *A43C 11/144* (2013.01); *A43C 11/1473* (2013.01); *A43C 11/1493* (2013.01)

(58) Field of Classification Search
USPC ..... 36/117.8, 117.7, 117.6, 117.9, 118.1,36/50.1, 50.5
See application file for complete search history.

(56) References Cited

U.S. PATENT DOCUMENTS 1,497,568 A * 6/1924 Kelley ..... A43C 11/00 36/51
1,792,923 A * 2/1931 O'Neil ..... A43C 11/00 24/69 SK
3,545,106 A * 12/1970 Martin ..... A43C 11/008 36/117.1
3,570,148 A * 3/1971 Morgan ..... A43B 13/08 36/118.8
3,722,112 A * 3/1973 Morgan ..... A43B 13/08 36/118.8
3,737,957 A * 6/1973 Steinberg ..... A43C 11/00 24/178
3,975,838 A * 8/1976 Martin ..... A43B 5/0427 24/71 SK
4,130,949 A * 12/1978 Seidel ..... A43C 11/1413 24/170
4,142,307 A * 3/1979 Martin ..... A43B 5/0447 24/68 SK
4,408,403 A * 10/1983 Martin ..... A43C 11/1406 36/115
4,587,747 A * 5/1986 Courvoisier ..... A43B 5/0433 36/105
4,706,393 A * 11/1987 Marxer ..... A43B 5/0447 24/68 SK
4,761,898 A * 8/1988 Courvoisier ..... A43C 11/1413 24/68 SK
5,152,084 A * 10/1992 Bonnaventure ..... A43B 5/0433 36/105
5,226,246 A * 7/1993 Soo ..... A43C 11/00 12/113
5,251,388 A * 10/1993 Pozzobon ..... A43C 11/1413 24/68 SK
5,345,697 A * 9/1994 Quellais ..... A43B 11/00 24/712
5,371,926 A * 12/1994 Van Noy ..... A43C 11/00 24/171
5,425,187 A * 6/1995 Artusi ..... A43B 5/0433 36/117.1
5,537,763 A * 7/1996 Donnadieu ..... A43C 1/00 36/50.1
5,570,522 A * 11/1996 Olson ..... A43C 11/008 36/115
5,659,982 A * 8/1997 Muraoka ..... A43B 3/0073 36/131
6,026,594 A * 2/2000 Fougere ..... A43B 5/0433 36/50.1
6,347,436 B1 * 2/2002 Barber ..... A43C 1/00 24/68 SK
6,543,159 B1 * 4/2003 Carpenter ..... A43B 3/0073 36/115
6,568,104 B2 * 5/2003 Liu ..... A43B 1/0081 24/712
6,640,466 B1 * 11/2003 Liu ..... A43B 1/0081 36/50.1
6,671,980 B1 * 1/2004 Liu ..... A43B 11/00 24/712
7,464,492 B2 * 12/2008 Marechal ..... A43B 5/1625 36/115
7,603,795 B2 * 10/2009 Pallatin ..... A43B 5/0415 24/68 SK
8,359,771 B2 * 1/2013 Holzer ..... A43B 5/0433 36/115
2007/0271824 A1 * 11/2007 Holzer ..... A43B 5/0433 36/87
2009/0090029 A1 * 4/2009 Kishino ..... A43C 11/00 36/116
2012/0079741 A1 * 4/2012 Kohatsu ..... A43B 3/26 36/50.1

FOREIGN PATENT DOCUMENTS

CH EP 0666037 A1 * 8/1995 ..... A43B 5/0433
CH 688 606 A5 12/1997
DE 693 01 215 T2 8/1996
EP 0492116 A1 7/1992
EP 2 591 696 A1 5/2013
IT EP 1935271 A1 * 6/2008 ..... A43C 11/142

OTHER PUBLICATIONS

Extended European Search Report issued Nov. 19, 2014 in EP Application No. 14173586.0.

* cited by examiner

SKI BOOT AND SIMILAR SPORT FOOTWEAR

FIELD OF THE INVENTION

The present invention concerns sport footwear, such as a ski boot or other similar footwear, such as a snowboard boot, trekking boot, or a skating boot, provided with a closing device which allows the selective clamping or release thereof.

BACKGROUND OF THE INVENTION

Sport footwear is known, such as ski boots, snowboard boots, trekking boots or other similar sport footwear, which can be provided with an upper part, or cuff, and a lower part, or shell.

These known boots can assume a first clamped position, or position of use, to clamp the ankle and shin zone during sporting activity, and a second, released or loosened position to facilitate the user in putting on and removing the boot, and in walking.

The shell includes a front tongue, to cover a front opening near the shin zone of the user's leg, which is generally bent and/or moved forward to facilitate the removal/insertion of the foot from/into the boot.

Sport boots are also known in which the opening is defined by distancing and separating lateral portions of the shell which normally overlap in correspondence with the shin zone.

Associated with the front part of the sport boot there are normally one or more closing mechanisms which allow to selectively regulate the intensity of closure of the main structure of the boot, to clamp the latter with respect to the foot and the shin zone of the user's leg.

Known sport boots are also generally provided with other closing mechanisms attached to the shell and/or the upper cuff, which selectively allow to clamp the ski boot in the upper part thereof, for use during sporting activity, or to release it so that it can be put on or removed.

To this purpose different types of closing mechanisms are known, which can include, for example, an attachment member with teeth, with which a closing lever engages, or a screw-type regulator, both configured to tighten the front part of the sport boot by bringing together two opposite sides of the lateral portions. The closing or tightening force can be regulated and selected by the user according to his/her own requirements.

A subsequent opening of the closing mechanisms allows to loosen the sport boot, so as to allow the user to remove it at the end of his/her sporting activity, or to facilitate walking during a pause in the activity.

Known closing mechanisms have the disadvantage, however, that they normally consist of complex and bulky mechanisms that entail an increased complexity in maneuvering for the user.

Among the types of closing mechanisms with which a sport boot is provided there is also a Velcro® strip, typically positioned in the upper part of the front or shin zone of the sport boot, and attached in the external part of the upper cuff.

To clamp the sport boot it is provided to insert the Velcro® strip inside an eyelet on a lateral part of the upper cuff.

The Velcro® strip is then returned toward the opposite side of the upper cuff and adjusted according to the user's requirements.

One disadvantage of known sport boots is that it is very inconvenient to adjust the closing mechanisms, especially the type with teeth attachment, which are very difficult to adjust with respect to the Velcro® strip.

During pauses or rest-stops in the sporting activity, or for example during an ascent or while walking, it is possible to open the closing mechanisms in the upper part of the sport boot, that is, the Velcro® strip and the first closing clip, to allow better use of the sport boot while walking.

Another disadvantage is that, when the user again needs to clamp the sport boot after the pause or rest-stop, he/she will not always be able to obtain the same adjustment as desired and set at the start of the day.

Moreover, the operation to clamp a known sport boot can occupy the user for a long time because, during use, the user will be wearing gloves, which limit the mobility of the user's hands.

Furthermore, during the operation to clamp a sport boot during use, the user is generally precariously balanced, for example on the snow, on a slippery and/or icy surface, often on a slope, which conditions are potentially dangerous.

Another obstacle to manipulating known closing mechanisms is that generally they are positioned under the user's trouser-legs, and he/she is therefore obstructed in driving the levers of the mechanisms.

German Patent 69301215 describes a ski boot that provides a shell, a upper cuff articulated on the shell and an inner boot. The upper cuff is in turn formed by two parts that are articulated with respect to each other, a front part and a rear part, which are reciprocally brought together and kept clamped by a closing system of levers. Moreover, a strip system is provided to tighten the inner boot.

Swiss patent application publication CH 688,606 A also describes a clamping device for a ski boot, including a shell and a upper cuff consisting of a front part and a rear part clamped to each other by a closing system of levers.

Swiss patent application publication CH 471 553 A describes another ski boot of a known type, provided with a single closing system with a connection clip.

European patent application publication EP 2 591 696 A describes another ski boot of a known type, provided with a single closing system including a connection cable.

There is therefore a need to perfect sport footwear, such as a ski boot or other similar footwear, that can overcome at least one of the disadvantages of the state of the art.

SUMMARY OF THE INVENTION

In particular, one purpose of the present invention is to obtain a sport footwear, such as a ski boot or other similar footwear, which is simple and convenient to clamp and/or release, or loosen, at least partly, for example during pauses or rest-stops in the sporting activity, without losing the desired adjustment of the closing force as determined by the user.

Another purpose of the present invention is to obtain a sport footwear that can be released or loosened even by a user wearing gloves, or trousers above the boot, or is precariously balanced.

The Applicant has devised, tested and embodied the present invention to overcome the shortcomings of the state of the art and to obtain these and other purposes and advantages.

In accordance with the above purposes, a sport footwear, such as a ski boot or similar footwear is provided, which overcomes the limits of the state of the art and eliminates the defects therein, and includes at least a single upper part, configured to act as the upper cuff, and a lower part that acts as the shell.

The upper part is provided with a pair of opposite and distanced lateral edges, on which at least a terminal closing mechanism with a band and at least another closing mechanism are provided; the second closing mechanism is positioned adjacent to the terminal closing mechanism, is a different type from the terminal closing mechanism with a band and includes an attachment member with teeth and an actuation lever. The terminal closing mechanism and the at least one other closing mechanism extend at the front and astride the lateral edges in order to both act in closing on the lateral edges.

According to some forms of embodiment of the present invention, the sport boot includes a single command mechanism configured to drive both the terminal closing mechanism and the at least one other closing mechanism at the same time. Moreover, the command mechanism includes at least a main lever pivoted on a first of the lateral edges and at least one connection element to cooperate with the terminal closing mechanism and with the at least one other closing mechanism. According to the present invention, the terminal closing mechanism and other closing mechanism are both provided with a respective drive end connected to the main lever, near the first of the lateral edges, and with an opposite anchoring end connected to a second of the lateral edges.

The command mechanism allows, in a completely innovative way with respect to the state of the art, by driving the main lever, the selective loosening and subsequent new and simultaneous clamping of the terminal closing mechanism and of the at least one other closing mechanism in correspondence to the upper shin part of the user's leg. This allows to bring together and distance the lateral edges of the upper cuff as necessary, opening and closing a corresponding front opening defined by the lateral edges, and to define the desired tightening force of the sport boot around the shin of the user's leg.

Advantageously, therefore, the command mechanism allows to close the shin area of the user's leg securely during the sporting activity, uniformly distributing the closing force over a wide area of the upper cuff and the sport boot and, at the same time, to command the simultaneous attenuation of the closing force of at least two closing mechanisms during rest-stops or pauses in the sporting activity.

In some forms of embodiment, the command mechanism includes at least a first pin connected to the upper cuff and to which a first arm of the main lever is pivoted, and at least a second pin, also connected to the upper cuff and to which a second arm of the main lever is pivoted. The first pin and second pin are aligned with each other and define an axis of rotation of the main lever.

In some forms of embodiment, the connection element, which can be a peg for example, cooperates with an intermediate zone of the two or more arms of the main lever and configured to define an axis of connection parallel or incident with respect to the axis of rotation.

In some forms of embodiment, the first arm and second arm of the main lever comprise a housing in which the connection element is housed. Moreover, the at least one connection element is configured to define at least an axis of connection essentially parallel to the axis of rotation.

According to some aspects of the present invention, the main lever is configured to rotate around the axis of rotation to assume at least a closed position, in which the at least one axis of connection is positioned, with reference to the upper cuff, to the rear with respect to the axis of rotation, and an open position, in which the at least one axis of connection is positioned, with reference to the upper cuff, at the front with respect to the axis of rotation.

The rotation of the lever, which can even be more than 180°, allows to simultaneously loosen the terminal closing mechanism and the at least one other closing mechanism, without changing the relative position of their respective components. In this way the advantage is obtained of being able to set the closing force of the at least two closing mechanisms, putting them under tension by positioning the main lever in the closed position. Moreover, another advantage is that the positioning of the main lever in the open position and its subsequent repositioning in the closed position allows to preserve the closing force as described above. In other words, it is possible with a single movement to restore the desired closing force of the at least two closing mechanisms after each pause in the sporting activity.

The present invention also concerns a closing device for a sport boot including at least a single upper part configured to act as upper cuff and a lower part that acts as lower shell, the upper part being provided with a pair of opposite and distanced lateral edges. The closing device includes at least a terminal closing mechanism with a band on the lateral edges. Moreover, the closing device also includes, on the same lateral edges, at least another closing mechanism of a different type with respect to the terminal closing mechanism with a band, positioned adjacent to the terminal closing mechanism. This other closing mechanism includes an attachment member with teeth and an actuation lever. Moreover, the terminal closing mechanism and the other closing mechanism extend frontally astride the lateral edges in order to both act in closing on the lateral edges. The one other closing mechanism includes a single command mechanism configured to drive both the terminal closing mechanism and the at least one other closing mechanism at the same time. The command mechanism includes at least a main lever pivoted on a first of the lateral edges and at least a connection element to cooperate with the terminal closing mechanism and with the at least one other closing mechanism. The terminal closing mechanism and the at least one other closing mechanism are both provided with a respective drive end connected to the main lever, near the first of the lateral edges, and with an opposite anchoring end connected to a second of the lateral edges.

These and other aspects, characteristics and advantages of the present disclosure will be better understood with reference to the following description, drawings and attached claims. The drawings, which are integrated and form part of the present description, show some forms of embodiment of the present invention, and together with the description, are intended to describe the principles of the disclosure.

The various aspects and characteristics described in the present description can be applied individually where possible.

BRIEF DESCRIPTION OF THE SEVERAL VIEWS OF THE DRAWINGS

These and other characteristics of the present invention will become apparent from the following description of a preferential form of embodiment, given as a non-restrictive example with reference to the attached drawings wherein.

Figure 1:
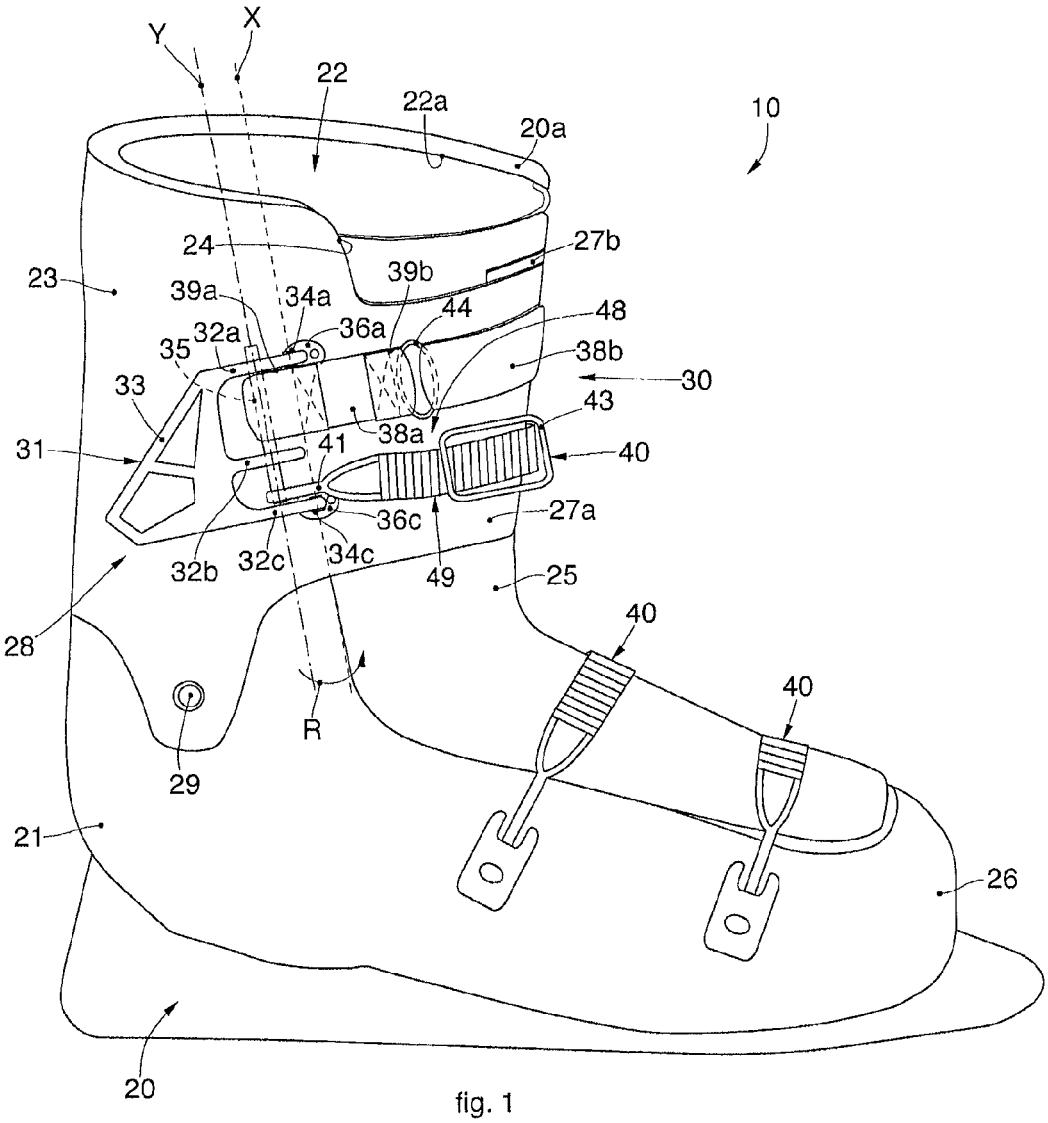
FIG. 1 is a lateral schematic view of a ski boot according to forms of embodiment described here.

To facilitate comprehension, the same reference numbers have been used, where possible, to identify identical common elements in the drawings. It is understood that elements and characteristics of one form of embodiment can conveniently be incorporated into other forms of embodiment without further clarifications.

DETAILED DESCRIPTION OF EMBODIMENTS OF THE INVENTION

We shall now refer in detail to the various forms of embodiment of the present invention, of which one or more examples are shown in the attached drawing. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

FIG. 1 is used to describe forms of embodiment of a ski boot or similar sport footwear according to the present invention, indicated in its entirety by the reference number 10.

In some forms of embodiment, which can be combined with all the forms of embodiment described here, the ski boot 10 can include a lower part or shell 21 and a single upper part or upper cuff 23, connected to each other in an articulated manner. For example, hinge 29 may be provided, to hinge the upper cuff 23 to the shell 21, allowing the articulation or reciprocal rotation thereof. The shell 21 typically has a compartment in which the user's foot can be positioned. On the contrary, the upper cuff 23 can typically surround and contain the user's ankle and a part of the leg at the height of the calf. In particular, the upper cuff 23 is formed by a single body that, according to needs, can be closed and tightened, typically thanks to the properties of flexibility and deformability of the material, generally polymer plastic, of which it is made, around the user's ankle and a part of the leg at the height of the calf.

All in all, shell 21 and upper cuff 23 can define a main structure 20 of the ski boot 10 which can be made, for example, of polymer plastic material or composite material, such as a polymer plastic material with reinforcement fibers, for example carbon fibers or glass fibers.

In some forms of embodiment, which can be combined with all the forms of embodiment described here, the main structure 20 is hollow inside and can delimit an internal compartment 22 in which, during use, the lower part of the user's leg is contained. Furthermore, the main structure 20 can be provided, at a top end, with an entrance edge 20*a* that delimits an entrance opening 22*a* through which the user inserts his/her foot into the internal compartment 22.

In some forms of embodiment, which can be combined with all the forms of embodiment described here, the main structure 20 can be shaped so as to have a front opening 24 as well, which, in addition to the entrance opening 22*a*, can facilitate the insertion of the user's foot into the internal compartment 22 of the main structure 20.

In possible implementations, a rigid front tongue 25 may be provided, which can be disposed in front of the front opening 24 of the ski boot 10, in correspondence with the user's shin zone.

In some forms of embodiment, which can be combined with all the forms of embodiment described here, the rigid tongue 25 may constitute a first closing element of the front opening 24 of the ski boot 10.

In some forms of embodiment, which can be combined with all the forms of embodiment described here, the rigid tongue 25 can be pivoted to the shell 21, near a tip or front end 26 of the ski boot 10.

The pivoting of the rigid tongue 25 can provide a partial oscillation of the same with respect to its pivoting point, so as to facilitate the insertion of the user's foot inside the ski boot 10.

In possible implementations, the ski boot 10 can possibly include a rigid tongue 25 divided into two or more parts, to allow the user better comfort when he/she inserts and removes his/her foot into/from the ski boot 10.

In some forms of embodiment, which can be combined with all the forms of embodiment described here, the rigid tongue 25 may be made in a single piece, although what follows can also be adapted to other types of rigid tongue, and also to ski boots 10 that do not have this component and in which the front opening 24 is normally closed by parts of the shell 21 that are overlapping and elastically deformable.

In some forms of embodiment, which can be combined with all the forms of embodiment described here, the upper cuff 23 in its upper part, near the entrance opening 22*a* and the part of the rigid tongue 25 that is opposite the pivoting part of the latter, can be provided with an external lateral edge 27*a* and an internal lateral edge 27*b*. The lateral edges 27*a* and 27*b* are typically brought close to and distanced from each other to define the front opening 24, in particular delimiting its sides. By bringing the lateral edges 27*a* and 27*b* close to each other, it is possible to close the front opening 24 to a greater or lesser degree, obtaining the desired tightening force around the shin zone of the user's leg.

In particular, the lateral edges, internal 27*b* and external 27*a*, can be configured to dispose themselves, during use, overlapping each other and the rigid tongue 25.

Consequently, in some forms of embodiment, the lateral edges 27*a*, 27*b* delimit the front opening 24 that has an open condition, in which the lateral edges 27*a*, 27*b* are distanced, and a closed condition, in which the lateral edges 27*a*, 27*b* overlap, which condition can be actuated by the action of the terminal closing mechanism 38 and the further closing mechanism 40.

According to some forms of embodiment, which can be combined with all the forms of embodiment described here, the lateral edges 27*a* and 27*b* can be made in a single piece with the remaining part of the upper cuff 23.

Alternatively, a variant upper cuff 23 can provide that the lateral edges 27*a*, 27*b* are made separately with respect to a part of the upper cuff 23 and subsequently attached thereto.

In some forms of embodiment, which can be combined with all the forms of embodiment described here, the lateral edges 27*a*, 27*b* can be made of different material from that of the remaining part of the upper cuff 23, and can be attached to it by any known attachment element.

Figure 2:
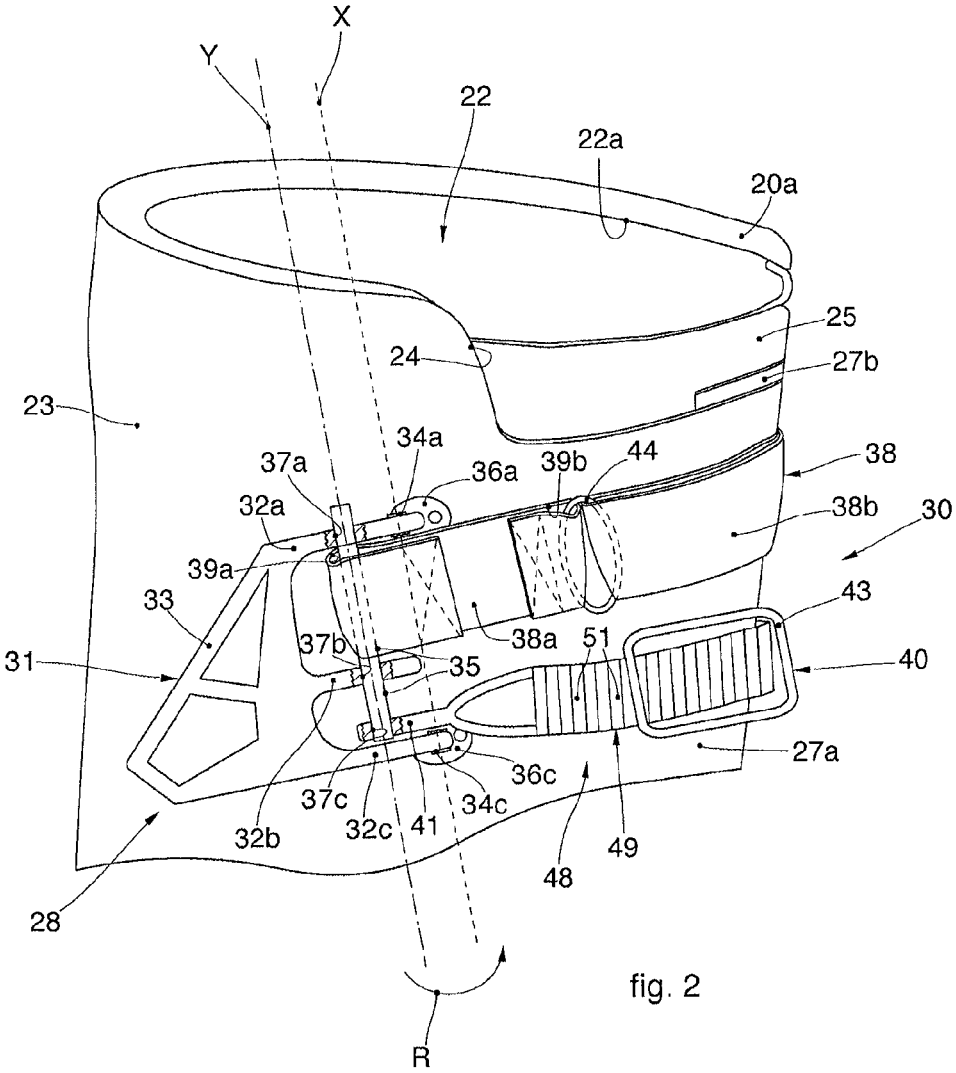
FIG. 2 is an enlarged view of a detail in FIG. 1.

In some forms of embodiment, described for example with reference to FIGS. 1 and 2, a closing device 30 can be provided, driven by a single command mechanism 28, to close the lateral edges 27*a* and 27*b*. The command mechanism 28 can include a main lever 31, which functions as an actuation member and can have any shape whatsoever.

In some forms of embodiment, which can be combined with all the forms of embodiment described here, the main lever 31 can be triangular, rectangular or trapezoid, and in any case an ergonomic shape so that the user can easily grip it.

Furthermore, the main lever 31 can have sizes such that it can be easily gripped using several fingers.

In some forms of embodiment, described by way of example using the attached drawings, the main lever 31 can be provided with a first arm 32*a*, a possible central arm 32*b* and a second arm 32*c*, all connected with each other by a handle 33.

In possible implementations, as well as the main lever 31, the command mechanism 28 can include a first pin 34*a* and a second pin 34*c*, to which a first end of the first arm 32*a* and a first end of the second arm 32*c* of the main lever 31 are respectively pivoted. The first 32*a* and second 32*c* arms can each have a second end, opposite the first end, connected to the handle 33.

Furthermore, in possible forms of embodiment, which can be combined with all the forms of embodiment described here, the command mechanism 28 can also provide a first attachment plate 36*a*, attached to the upper cuff 23 and cooperating with the first pin 34*a* to define the pivoting of the first arm 32*a* to the upper cuff 23, and a second attachment plate 36*c*, cooperating with the second pin 34*c* to define the pivoting of the second arm 32*c* to the upper cuff 23.

In particular, in some forms of embodiment, which can be combined with all the forms of embodiment described here, the attachment plates 36*a* and 36*c* are attached to the same lateral edge 27*a*, 27*b*, in this case to the external lateral edge 27*a*.

In some forms of embodiment, which can be combined with all the forms of embodiment described here, the pins 34*a* and 34*c* are disposed so as to have axes aligned to define an axis of rotation X around which the main lever 31 can rotate, when a user acts on the handle 33, as indicated by arrow R in FIGS. 1 and 2.

In possible forms of embodiment, which can be combined with all the forms of embodiment described here, the first arm 32*a*, the second arm 32*c* and the possible central arm 32*b* can cooperate in an intermediate zone thereof with at least one connection element, for example a peg 35 or in any case an element with an essentially oblong shape, which connects the first arm 32*a* to the second arm 32*c* in the intermediate zone.

In particular, the peg 35 can have a longitudinal development defining a axis of connection Y.

In forms of embodiment that include more than one connection element, it is possible to have more than one axis of connection Y, parallel to each other.

In some forms of embodiment, the disposition of the peg 35 is such that the axis of connection Y is parallel to the axis of rotation X.

Other forms of embodiment may provide that the axis of connection Y is incident with respect to the axis of rotation X In possible implementations, the central arm 32*b*, the first arm 32*a* and the second arm 32*c* can include respective through holes 37*a*, 37*b*, 37*c*, for example eyelets or slits, which in the cases shown by way of example in the attached drawings are all aligned with each other.

In other forms of embodiment, not shown in the drawings, the central arm 32*b* can be equipped with a pair of through holes, one aligned with the through hole 37*a* of the first arm 32*a* and one aligned with the through hole 37*c* of the second arm 32*c*, which in its turn is not aligned with the through hole 37*a*. In this form of embodiment, there are therefore two distinct axes of connection Y.

With reference to forms of embodiment described using FIG. 2, the closing device 30 includes a single peg 35, inserted into the through holes 37*a*, 37*b* and 37*c* and having its axis disposed along the axis of connection Y.

In this way, the through holes 37*a*, 37*b* and 37*c* function as a housing for the peg 35.

The coupling of the through holes 37*a*, 37*b*, 37*c* and peg 35 can be achieved with play, so that the peg 35 is rotatable inside its own housing.

In some forms of embodiment, which can be combined with all the forms of embodiment described here, a terminal closing mechanism 38, flexible, and at least another closing mechanism, rigid, in this case a closing clip 40, can be associated with the top part of the upper cuff 23. The terminal closing mechanism 38 is the mechanism of the ski boot 10 positioned closest to the entrance opening 22*a*, while the closing clip 40 is positioned adjacent to the terminal closing mechanism 38.

In some forms of embodiment, which can be combined with all the forms of embodiment described here, the closing device 30 can include not only the command mechanism 28, but also the terminal closing mechanism 38, and the closing clip 40. As we the, there is only one command mechanism 28 for the terminal closing mechanism 38 and the closing clip 40, and it is configured to drive them simultaneously.

In some forms of embodiment, which can be combined with all the forms of embodiment described here, the closing clip 40 is configured to determine the closing force and the main shaping of the upper cuff 23 around the user's leg in the zone of the ski boot 10, near the entrance opening 22*a*. In other words, the closing clip 40 defines how, and to what extent, the upper cuff 23 surrounds the user's leg.

In some forms of embodiment, which can be combined with all the forms of embodiment described here, the terminal closing mechanism 38 can typically have the function of determining a closure and final shaping, after the main shaping performed by the closing clip 40, and can allow a continuous and more precise adjustment of the force for closing the ski boot 10 on the user's shin and calf.

The command mechanism 28 allows to consolidate the closure performed by the terminal closing mechanism 38 and the closing clip 40 of the closing device 30, causing the simultaneous tensioning of both, as will become clear hereafter in the description.

Some forms of embodiment of the terminal closing mechanism 38, described by way of example using FIG. 2, include at least a connection band 38*a*, connected to the main lever 31 by the peg 35 and defining a drive end of the terminal closing mechanism 38.

In some forms of embodiment, which can be combined with all the forms of embodiment described here, the connection band 38*a* can be positioned between the first arm 32*a* and the central arm 32*b* of the main lever 31.

The connection band 38*a* can be attached to one of the lateral edges, internal 27*b* or external 27*a*, by any known attachment element.

The attached drawings are used to describe forms of embodiment in which the connection band 38*a* can be attached to the external lateral edge 27*a*.

In some forms of embodiment, which can be combined with all the forms of embodiment described here, the connection between the connection band 38*a* and the peg 35 can be achieved by inserting the latter inside a first housing seating 39*a*, for example an eyelet or slit, made by bending a first end portion of the connection band 38*a* back on itself and then attaching it, for example by stitching or riveting. The end portion therefore in practice surrounds the peg 35.

In some forms of embodiment, which can be combined with all the forms of embodiment described here, the connection band 38*a* can be made of a flexible material, such as for example a fabric of natural, synthetic or mixed fibers, or a leather or substitutes thereof, or again a plastic or composite material. The connection band 38*a* can be, for example, a flexible strip or band.

In some forms of embodiment, which can be combined with all the forms of embodiment described here, at the opposite end of the connection band 38*a* with respect to the one where the first housing seating 39*a* is made, there is a second housing seating 39*b*, for example an eyelet or slit, made by bending a second end portion of the connection band 38*a* back on itself and then attaching it, for example by stitching or riveting.

In some forms of embodiment, which can be combined with all the forms of embodiment described here, the second housing seating 39*b* is configured to house a part of a join element 44, with the function of determining the coupling of the connection band 38*a* and a closing band 38*b*.

In some forms of embodiment, which can be combined with all the forms of embodiment described here, the join element can be for example a ring, circular, oval or polygonal, or a buckle, or other similar element suitable to determine the coupling.

In some forms of embodiment, which can be combined with all the forms of embodiment described here, the closing band 38*b* can be attached to the lateral edge, external 27*a* or internal 27*b*, opposite the one used for the connection band 38*a*, using any known attachment element, and defines an anchoring end of the terminal closing mechanism 38.

In some forms of embodiment, which can be combined with all the forms of embodiment described here, the closing band 38*b* can also be made to pass around the opposite part of the join element 44 with respect to the part affected by the connection band 38*a*, and then bent back on itself, in an overlapping clamping condition.

In some forms of embodiment, which can be combined with all the forms of embodiment described here, the closing band 38*b* can include an internal portion 138*a*, located during use in contact with the external lateral edge 27*a*, and an external portion 138*b*, bent back and overlapping on the internal portion 138*a*, after being made to pass inside the join element 44.

After the passage of the closing band 38*b*, or at least of its external portion 138*b*, inside the join element 44, it is stretched toward its point of attachment to the upper cuff 23, overlapping the external portion 138*b* over the internal portion 138*a* and making them adhere firmly to each other.

The tension applied in this way brings together the connection band 38*a* and the closing band 38*b* and consequently increases the zone where the external lateral edge 27*a* overlaps the internal lateral edge 27*b*. This allows the user to select the clamping intensity and closing force in the shin part of the ski boot 10.

To obtain this purpose, the closing band 38*b* can be made for example of flexible material, such as for example a fabric of natural, synthetic or mixed fibers, or leather or its substitutes, or again a plastic or composite material.

In some forms of embodiment, which can be combined with all the forms of embodiment described here, the internal portion 138*a* and the external portion 138*b* of the closing band 38*b* can be defined by two reciprocally adhesive strips, for example two complementary strips of a Velcro® tape, or a tear-off tape.

In other forms of embodiment, a removable attachment can be provided between the two portions 138*a* and 138*b*, for example buttons, buckles or suchlike.

In some forms of embodiment, which can be combined with all the forms of embodiment described here, the peg 35 can also cooperate with an appendix 41 of the closing clip 40, which defines the drive end of the latter. The appendix 41 can be positioned between the central arm 32*b* and the second arm 32*c* of the main lever 31.

Forms of embodiment of the closing clip 40, described for example with reference to FIGS. 1 and 2, can include an attachment member with teeth 48. The attachment member with teeth 48, in some implementations, can include a band with close teeth, or toothed plate 49, for example formed by a plurality of teeth 51 one after the other and very close together (as for example in FIG. 2). In other implementations instead, the attachment member with teeth 48 can include a band or plate with teeth spaced further apart, that is, more distanced, and bigger, like a rack 42 (as for example in FIGS. 4 and 5) defined by a series of ridges 42*a* and grooves 42*b* reciprocally alternate to define a desired number of teeth, for example six or seven.

In some forms of embodiment, which can be combined with all the forms of embodiment described here, the closing clip 40 can also include an actuation lever 43 (only partly visible in FIGS. 1 and 2) which can be attached to the internal lateral edge 27*b* of the upper cuff 23 by any known attachment element. In this way, the actuation lever 43 defines the anchoring end of the closing clip 40.

Solutions can be provided in which the appendix 41 is part of the attachment member with teeth 48, and also solutions in which it is part of the actuation lever 43.

In some forms of embodiment, in which the main lever 31 is attached to the internal lateral edge 27*b*, the actuation lever 43 is attached to the external lateral edge 27*a*.

In some forms of embodiment, which can be combined with all the forms of embodiment described here, the actuation lever 43 can cooperate with the attachment member with teeth 48 to achieve the selective clamping of the closing clip 40. The command mechanism 28 can determine a tensioning thereof, to increase the closing force.

It is possible to provide, in other forms of embodiment of the present invention, different closing clips 40, for example provided with a screw-type regulator instead of the attachment member with teeth 48 and the actuation lever 43.

In some forms of embodiment, which can be combined with all the forms of embodiment described here, the main lever 31 of the closing device 30 is configured to assume, as shown with reference to FIGS. 1 to 3*a*, at least a closed position in which the peg 35, and hence the axis of connection Y, is located, with reference to the upper cuff 23, at the rear of the first 34*a* and second 34*c* pins, and hence with respect to the axis of rotation X.

In the closed position of the main lever 31, the tensioning of the closing device 30, that is, the terminal closing mechanism 38 and the closing clip 40, is at its maximum.

Figure 3B:
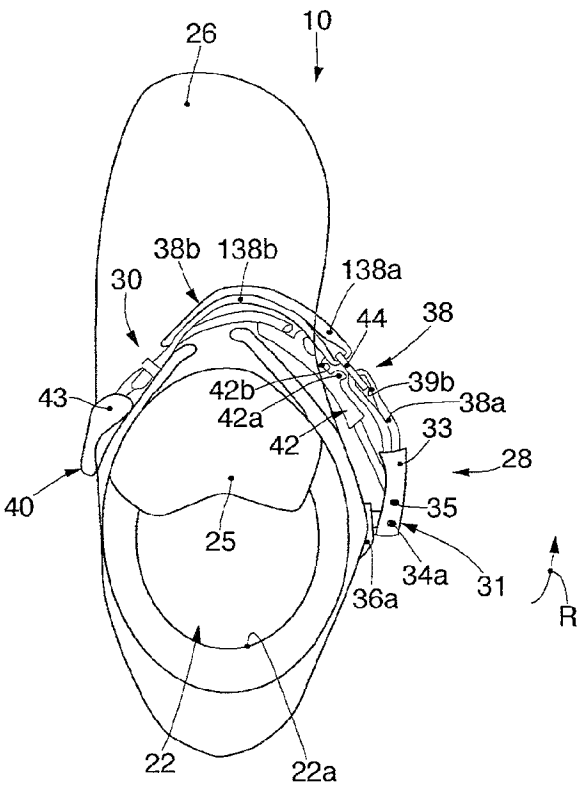
FIG. 3*b* is a schematic view from above of the ski boot in FIG. 1 provided with a closing device according to forms of embodiment described here, in an open position.
Figure 3A:
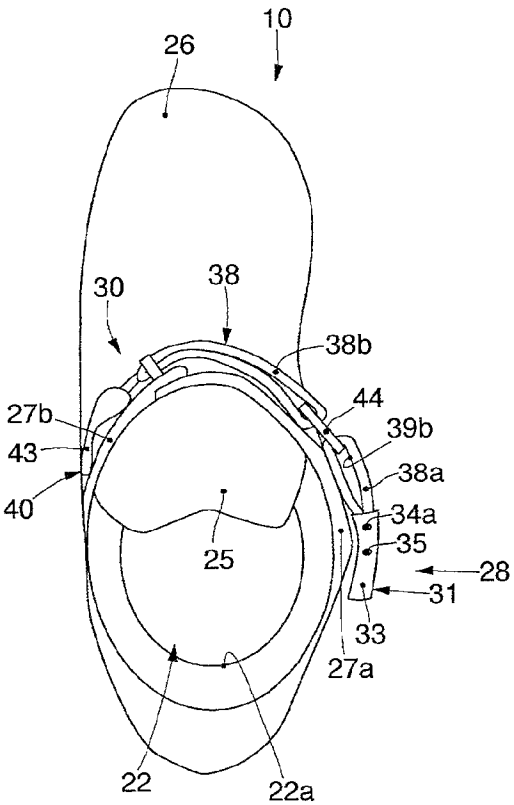
FIG. 3*a* is a schematic view from above of the ski boot in FIG. 1 provided with a closing device according to forms of embodiment described here, in a closed position.

Furthermore, the pivoting of the main lever 31 to the pins 34*a* and 34*c* allows a rotation thereof around the axis of rotation X by as much as 180° or more, to pass from the closed position to an open position, shown for example in FIG. 3*b*.

The rotation of the main lever 31 can cover for example an angle comprised between 90° and 200°.

In the open position, the peg 35, and hence the axis of connection Y, is located with reference to the upper cuff 23 in front of the first 34*a* and second 34*c* pins, and hence with respect to the axis of rotation X.

The rotation of the main lever 31 with respect to the axis of rotation X determines a displacement of the connection band 38*a* and of the appendix 41, and hence of the attachment member with teeth 48, toward the front part of the ski boot 10, causing a slackening of the closing force applied by the closing device 30 on the shin zone of the ski boot 10.

The above cited force is determined both by the tensioning of the connection band 38*a* of the terminal closing mechanism 38, and also by the clamping action of the closing clip 40 by the cooperation between the actuation lever 43 and the attachment member with teeth 48, and is determined by the previous closure of the command mechanism 28.

After clamping both the connection band 38*a*, making the internal 138*a*and external 138*b* portions adhere, and also the closing clip 40, the main lever 31 can be positioned in the closed position, in which it may be substantially parallel with the wall of the upper cuff 23 (FIGS. 1-3*a*).

In this way, the closing device 30 defines a narrowing of the cross section of the upper cuff 23, in particular near the entrance opening 22*a* and, with reference to the above, a reciprocal bringing together of the two lateral edges 27*a* and 27*b*. The closing force is proportional to the narrowing in section and the bringing together of the lateral edges 27*a* and 27*b*.

Afterward, in order to loosen the closing device 30, for example with reference to FIG. 3*b*, the command mechanism 28 can be released, rotating the main lever 31 in an anti-clockwise direction around the axis of rotation X and along the arrow R.

The direction of rotation can be either anti-clockwise or clockwise, depending on whether it is a left or right ski boot 10, or the main lever 31 of the closing device 30 is positioned on one or the other of the lateral edges 27*a*, 27*b* of the upper cuff 23.

The main lever 31, in any case, is configured to pass from the closed position to the open position, in which it can be disposed in closer proximity to the front part of the ski boot 10 with respect to the closed position.

During the rotation, the peg 35 thrusts both the connection band 38*a* and the attachment member with teeth 48 toward the same front part of the ski boot 10.

The thrusting action can also have as a consequence a lifting or detachment of the terminal closing mechanism 38 and the closing clip 40 with respect to the upper cuff 23.

All this takes place with the terminal closing mechanism 38 and the closing clip 40 clamped and tightened with the closing force predetermined by the user.

In the open position of the main lever 31 therefore, the terminal closing mechanism 38 and the closing clip 40 are simultaneously loosened, thus allowing the reciprocal distancing of the lateral edges 27*a* and 27*b* of the upper cuff 23 without intervening on the reciprocal position of the external 138*b* and internal 138*a* portions of the closing band 38*b*, nor on the reciprocal position of the actuation lever 43 in the attachment member with teeth 48.

In the same way, the rigid tongue 25 covering the front opening 24 can also move forward, facilitating the user when walking and increasing his/her comfort.

On the basis of the above, the passage of the main lever 31 from the closed position to the open position defines a widening of the cross section of the upper cuff 23 and, with reference to what is described above, a reciprocal distancing of the two lateral edges 27*a* and 27*b*.

Advantageously, in some forms of embodiment, which can be combined with all the forms of embodiment described here, the closing device 30 can allow to securely close the shin zone of the user's leg, distributing the closing force uniformly over a wide zone of the upper cuff 23 of the ski boot 10.

In some forms of embodiment, which can be combined with all the forms of embodiment described here, moreover, the handle 33 of the main lever 31 can have sizes such as to be easily gripped and driven even if the user is wearing gloves.

In this way, the closing device 30 can provide a rapid clamping and release of the ski boot 10 in correspondence with the upper shin zone of the user's leg thanks to the presence of the main lever 31.

Based on the above, it is clear that an inverse rotation of the main lever 31 after the loosening as described above, from the open position to the closed position, allows to restore the same closing force predetermined by the user before loosening the closing device 30.

In this way, the user, with a single and simple gesture, is able to reduce the closing force in the shin zone of the ski boot 10 during pauses in the sporting activity, and to restore the same closing force when he/she returns to the sporting activity.

It is clear that modifications and/or additions of parts may be made to the sport footwear as described heretofore, without departing from the field and scope of the present invention.

Forms of embodiment may be provided, for example, described with reference to FIGS. 4 to 6 and which can be combined with all the forms of embodiment described here, in which the attachment plates 36*a* and 36*c* are replaced by a single attachment plate 136 on which the first pin 34*a* and the second pin 34*c* for pivoting the main lever 31 are attached.

In variant solutions, moreover, the central arm 32*b* of the main lever 31 can have a first end connected to the handle 33 and a second end, opposite the first end, free and provided with a cam profile 45.

In some forms of embodiment, which can be combined with all the forms of embodiment described here, the cam profile 45 is configured to press against an elastic foil 46, such as for example a flexible foil. The elastic foil can be configured for example to function as an elastic return element and can be made, for example, of harmonic steel, or a polymer plastic material, or again a composite material. For example, the cam profile 45 can provide two protrusions or teeth 45*a*, 45*b*, which cooperate alternately with the elastic foil 46 (see for example FIG. 6).

Figure 4:
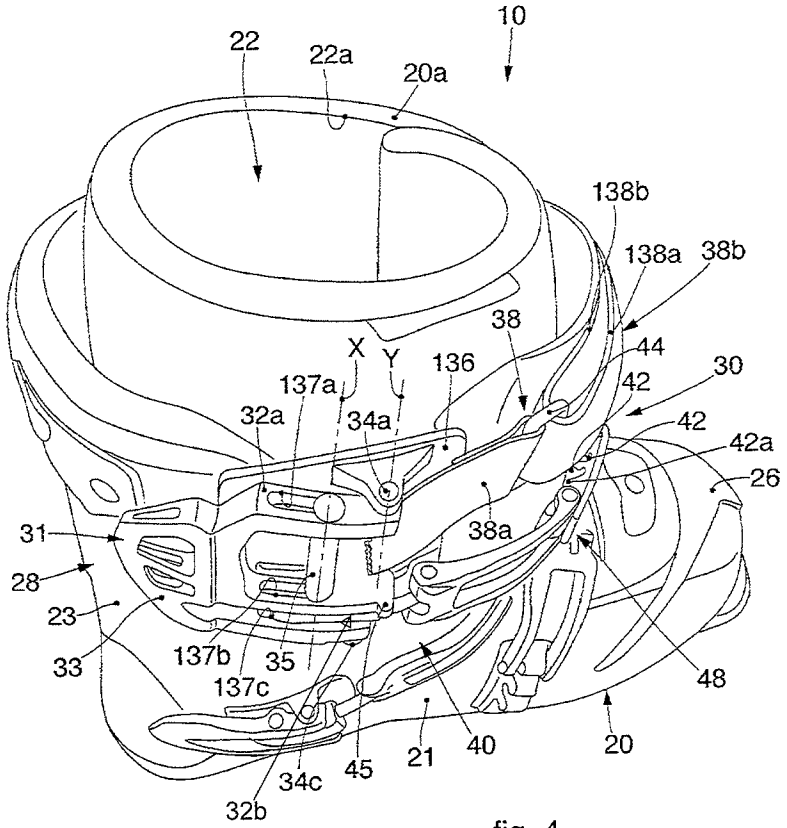
FIG. 4 is a three-dimensional view of a variant of FIG. 3*a;*
Figure 6:
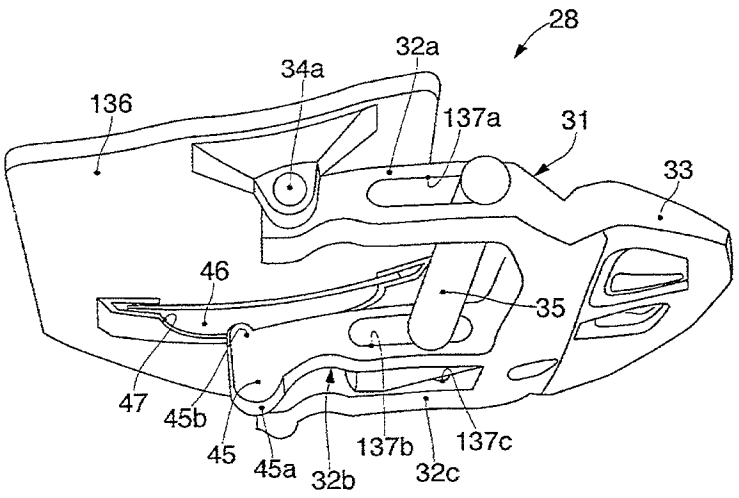
FIG. 6 is a three-dimensional view of an enlarged detail in FIG. 5.
Figure 5:
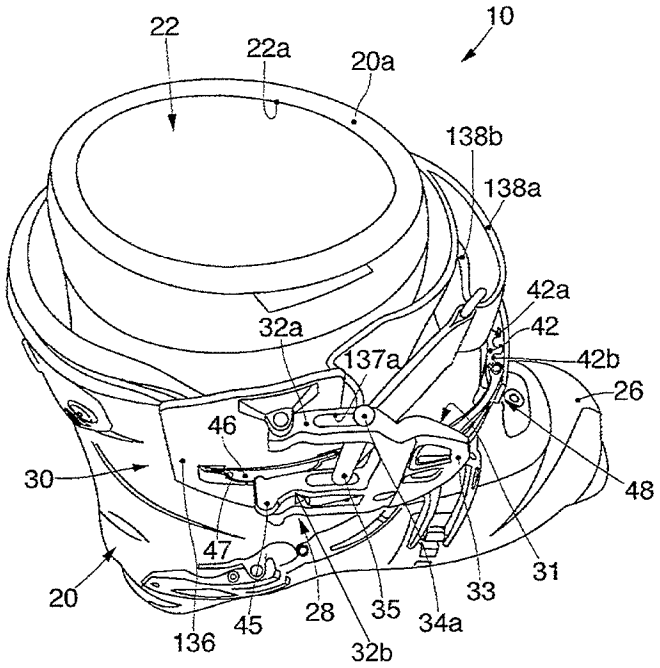
FIG. 5 is a three-dimensional view of a variant of FIG. 3*b;*

In some forms of embodiment, shown by way of example in FIGS. 4-6 and which can be combined with all the forms of embodiment described here, the elastic foil 46 is attached to the attachment plate 136.

In some forms of embodiment, which can be combined with all the forms of embodiment described here, the elastic foil 46 can be inserted into a suitable housing seating 47, constrained at the longitudinal ends and curved toward the outside of the ski boot 10.

The cooperation between the cam profile 45 and the elastic foil 46 provides that the latter thrusts the former, so that when the main lever 31 is in the open position, it remains there, and any accidental rotation thereof around the axis of rotation X is prevented.

In the same way, the elastic foil 46 thrusts on the cam profile 45 even when the main lever 31 is in the closed position, to keep it in the position and prevent accidental rotations thereof during the sporting activity.

Consequently, the cooperation of the elastic foil 46 and the cam profile 45 advantageously prevents any accidental release. In particular, the elastic foil 46 is always in contact with, advantageously thrusting against, the cam profile 45, in particular with one of the two teeth 45*a*, 45*b* depending on the position of the main lever 31 so that, when the main lever 31 is open, the free and uncontrolled rotation thereof is prevented, whereas when it is closed, any unwanted opening thereof is prevented.

The reference to the elastic foil 46 must be understood only as an example of an elastic return element, but other similar or comparable elements, for example a spring, a leaf spring, a cup spring or a helical spring can be provided without departing from the field of the present invention.

In order to rotate the main lever 31 from the closed position to the open position or vice versa, it is necessary to overcome the resistance of the elastic foil 46.

Furthermore, in some forms of embodiment, described by way of example with reference to FIGS. 4 to 6, the main lever 31 can include, instead of the through holes 37*a*, 37*b*, 37*c*, through eyelets 137*a*, 137*b* and 137*c*, made respectively in the first arm 32*a*, the central arm 32*b* and the second arm 32*c* of the main lever 31.

In some forms of embodiment, which can be combined with all the forms of embodiment described here, the through eyelets 137*a*, 137*b*, 137*c* can be aligned with each other and can function as a housing for the peg 35.

In some forms of embodiment, which can be combined with all the forms of embodiment described here, the through eyelets 137*a*, 137*b*, 137*c* are configured to guide the sliding of the peg 35 housed inside them. The sliding is intended to facilitate the closing movement, since the fulcrum of the lever is brought nearer the resistant force, generating a more favorable lever arm. Furthermore, the sliding also facilitates release during opening. Moreover, the sliding of the peg 35 along the through eyelets 137*a*, 137*b*, 137*c* can allow a greater opening of the closing device 30, and hence a greater slackening of the closing force on the user's calf and shin, for example during periods of rest or pauses in the sporting activity.

It is also clear that, although the present invention has been described with reference to some specific examples, a person of skill in the art shall certainly be able to achieve many other equivalent forms of sport footwear, having the characteristics as set forth in the claims and hence all coming within the field of protection defined thereby.

We claim:

1. A sport footwear comprising at least a single upper part (23) configured to act as an upper cuff and a lower part (21) acting as a lower shell, the upper part (23) having a pair of opposite and distanced lateral edges (27*a*, 27*b*) at least one terminal closing mechanism (38) operatively connected to lateral edges (27*a*, 27*b*), at least one other closing mechanism (40) operatively connected to the lateral edges (27*a*, 27*b*), the at least one other closing mechanism (40) being different than the at least one terminal closing mechanism (38) and comprising an attachment member having teeth (48) and an actuation lever (43), the at least one other closing mechanism (40) positioned adjacent to the at least one terminal closing mechanism (38), the at least one terminal closing mechanism (38) and the at least one other closing mechanism (40) extending frontally astride the lateral edges (27*a*, 27*b*) in order to act in closing on the lateral edges (27*a*, 27*b*), wherein the at least one other closing mechanism (40) comprises a single command mechanism (28) configured to drive both the at least one terminal closing mechanism (38) and the at least one other closing mechanism (40) at the same time, the command mechanism (28) comprising at least one main lever (31) pivoted on a first (27*a*) of the lateral edges (27*a*, 27*b*) and at least one connection element (35) to cooperate with the at least one terminal closing mechanism (38) and with the at least one other closing mechanism (40), wherein the at least one terminal closing mechanism (38) and the at least one other closing mechanism (40) are each provided with a respective drive end, connected to the at least one main lever (31), near the first (27*a*) of the lateral edges (27*a*, 27*b*), and with an opposite anchoring end (38*b*, 43) connected to a second (27*b*) of the lateral edges (27*b*, 27*a*), wherein the at least one main lever (31) comprises at least two arms (32*a*, 32*b*, 32*c*), the command mechanism (28) comprises at least a first pin (34*a*) connected to the upper part (23) and to which a first arm (32*a*) of the at least one main lever (31) is pivoted, and at least a second pin (34*c*) connected to the upper part (23) and to which a second arm (32*c*) of the at least one main lever (31) is pivoted, the first pin (34*a*) and second pin (34*c*) being aligned to define an axis of rotation (X) of the at least one main lever (31), wherein the connection element (35) cooperates with an intermediate zone of the at least two arms (32*a*, 32*b*, 32*c*) of the at least one main lever (31) and is configured to define an axis of connection (Y) parallel or incident with respect to the axis of rotation (X), wherein the drive end of the at least one other closing mechanism (40) comprises an appendix (41) of the attachment member with teeth (48) or of the actuation lever (43), connected to the connection element (35), wherein the at least one main lever (31) comprises a central arm (32*b*) located in an intermediate position with respect to the first arm (32*a*) and the second arm (32*c*), wherein the drive end of the at least one terminal closing mechanism (38) includes a connection band (38*a*) connected to the at least one main lever (31) in the part of the connection element (35) comprised between the first arm (32*a*) and the central arm (32*b*), and the appendix (41) is connected to the at least one main lever (31) in the part of the connection element (35) comprised between the central arm (32*b*) and the second arm (32*c*).

2. The sport footwear as in claim 1, wherein the connection element (35) comprises a peg, the at least two arms (32*a*, 32*b*, 32*c*) of the at least one main lever (31) comprising a housing (37*a*, 37*b*, 37*c*; 137*a*, 137*b*, 137*c*) in which the peg is housed.

3. The sport footwear as in claim 2, wherein the housing comprises through holes (37*a*, 37*b*, 37*c*) made in the at least two arms (32*a*, 32*b*, 32*c*) of the at least one main lever (31) and aligned along the axis of connection (Y).

4. The sport footwear as in claim 1, wherein the at least one main lever (31) is configured to rotate around the axis of rotation (X) to assume at least a closed position, in which the axis of connection (Y) is positioned, with reference to the upper part (23), to the rear with respect to the axis of rotation (X).

5. The sport footwear as in claim 1, wherein the at least one main lever (31) is configured to rotate around the axis of rotation (X) to assume at least an open position, in which the axis of connection (Y) is positioned, with reference to the upper part (23), to the front with respect to the axis of rotation (X).

6. The sport footwear as in claim 4, wherein in the closed position the at least one main lever (31) is rotated by an angle between 90° and 200° with respect to the open position.

7. The sport footwear as in claim 1, wherein the at least one terminal closing mechanism (38) and the at least one other closing mechanism (40) are both connected to the connection element (35).

8. The sport footwear as in claim 1, wherein the at least one terminal closing mechanism (38) comprises a closing band (38*b*) coupled to the connection band (38*a*) by a joint element (44), the connection band (38*a*) defining the drive end of the at least one terminal closing mechanism (38) and the closing band (38*b*) defining the anchoring end of the at least one terminal closing mechanism (38) to one of the lateral ends (27*b*, 27*a*).

9. The sport footwear as in claim 1, wherein the connection band (38*a*) is connected to the at least one main lever (31) by an at least partial winding around the connection element (35).

10. The sport footwear as in claim 1, wherein the lateral edges (27*a*, 27*b*) delimit a front opening (24) having an open condition, in which the lateral edges (27*a*, 27*b*) are distanced, and a closed condition, in which the lateral edges (27*a*, 27*b*) are overlapping, actuated by action of the at least one terminal closing mechanism (38) and the at least one other closing mechanism (40).

* * * * *